United States Patent [19]

Ikegami et al.

[11] 4,448,664

[45] May 15, 1984

[54] ANODE FOR ELECTROLYSIS

[75] Inventors: Tadao Ikegami; Takeshi Miyamoto, both of Tamano, Japan

[73] Assignee: Chlorine Engineers Corp., Ltd., Tokyo, Japan

[21] Appl. No.: 501,717

[22] Filed: Jun. 6, 1983

[30] Foreign Application Priority Data

Jul. 22, 1982 [JP] Japan ..... 57-110298[U]

[51] Int. Cl.³ ..... C25B 11/02; H01R 43/00

[52] U.S. Cl. ..... 204/286; 204/253; 204/288

[58] Field of Search ..... 204/286, 253, 263, 252, 204/288, 254

[56] References Cited

U.S. PATENT DOCUMENTS

| | | | |
|---|---|---|---|
| 3,674,676 | 7/1972 | Fogelman | 204/286 |
| 3,930,980 | 1/1976 | de Nora et al. | 204/256 |
| 3,980,545 | 9/1976 | de Lachaux et al. | 204/286 |
| 4,033,849 | 7/1977 | Pohto et al. | 204/286 |
| 4,154,667 | 5/1979 | Pohto et al. | 204/286 |
| 4,279,731 | 7/1981 | Pellegri | 204/254 |
| 4,343,689 | 8/1982 | de Nora et al. | 204/253 |

*Primary Examiner*—T. Tung
*Assistant Examiner*—Nathan Thane
*Attorney, Agent, or Firm*—Kuhn, Muller and Bazerman

[57] ABSTRACT

An anode for electrolysis includes an electrically conductive bar erected on an electrolytic cell bottom plate, opposed anode bodies connected to the electrically conductive bar through anode supporting bodies, and reinforcing bodies provided between the opposed anode bodies and outside the anode supporting bodies.

1 Claim, 5 Drawing Figures

ANODE FOR ELECTROLYSIS

BACKGROUND OF THE INVENTION

This invention relates to an anode for electrolysis and, more particularly, to a reinforced expandable anode for electrolysis.

A conventional expandable anode is illustrated in FIGS. 1,2 and 3(U.S. Pat. No. 3,674,676). Electrolysis can be operated effectively, at low voltage and with decreased power consumption, by arranging the anode as closely as possible to the cathode.

As shown in FIGS. 1–3, a dual anode assembly can be easily installed by initially maintaining an ample distance between each anode B and a cathode E adjacent thereto by means of a clamp piece D. The clamp piece D is initially connected in a restraining engagement with the two opposed end portions of an elastic supporting body C as shown in FIG. 2. The elastic supporting body C is connected to an electrically conductive bar A and the anodes B. Upon removal of the clamp piece D, the elastic supporting body C expands so as to urge and move the anode B outwardly to a position more closely adjacent to the cathodes E, as shown in FIG. 3, so that the electrolysis may be effectively operated.

Anode assemblies of this type have certain drawbacks. Either anode B may be disadvantageously deformed by exteral force because the anode B is unsupported around its end portions as shown in FIG. 3.

Moreover, the electrolyte does not flow smoothly since the electrolyte which, befoe electrolysis, flows downwardly within the electrolytic cell, and which after electrolysis, flows upwardly, is mixed with the gas generated during electrolysis.

SUMMARY OF THE INVENTION

In accordance with the invention, there is an improved reinforced anode in which reinforced bodies are provided between opposed anode bodies and which includes anode supporting means at the outer ends of the anode bodies.

Another feature of the inventive structure is the provision of an anode having a path through which electrolyte runs smoothly.

The improved anode of the invention includes an electrically conductive bar erected on an electrolytic cell bottom plate and opposed anode bodies. The opposed anode bodies are connected to the electrically conductive bar through anode supporting bodies, and reinforcing bodies provided between the opposed anode bodies at the outer ends of the anode supporting bodies.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts through the same.

DETAILED DESCRIPTION

Figure 1:
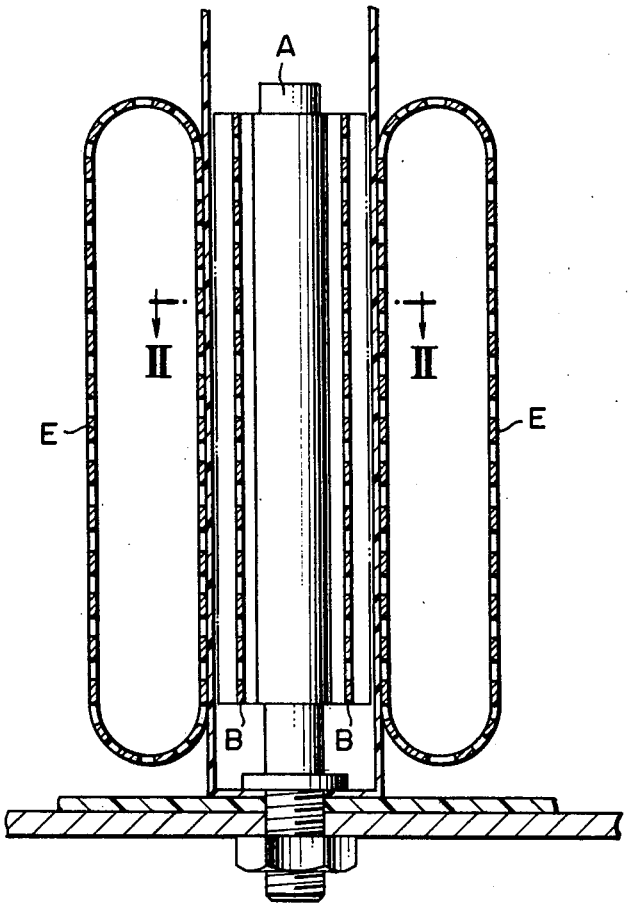
FIG. 1 PRIOR ART
FIG. 1 is a longitudinal section of a conventional expandable anode before expansion.
Figure 2:
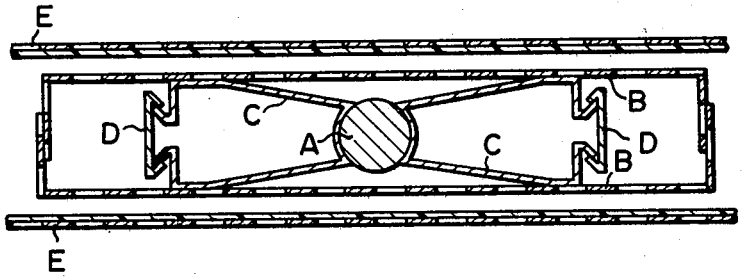
FIG. 2 PRIOR ART
FIG. 2 is a transverse sectional view taken along line II—II in FIG. 1.
Figure 3:
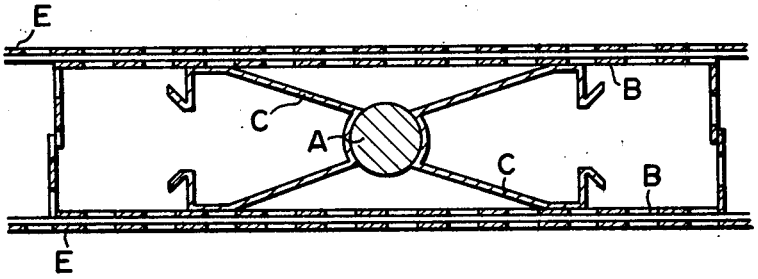
FIG. 3 PRIOR ART
FIG. 3 is a transverse sectional view illustrating the expandable anode of FIG. 1 after expansion.
Figure 4:
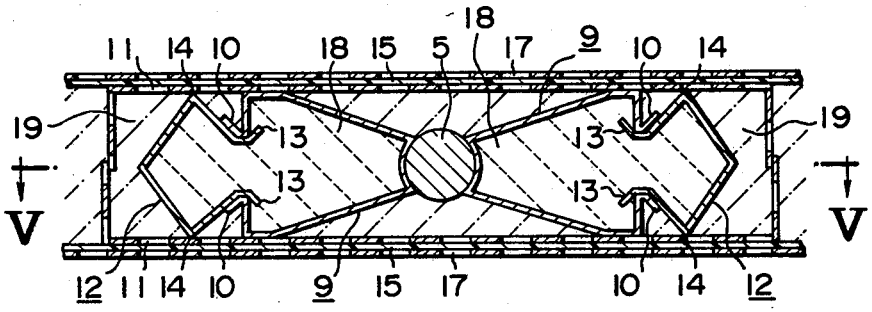
FIG. 4 is a transverse sectional view of a preferred embodiment according to the present invention.
Figure 5:
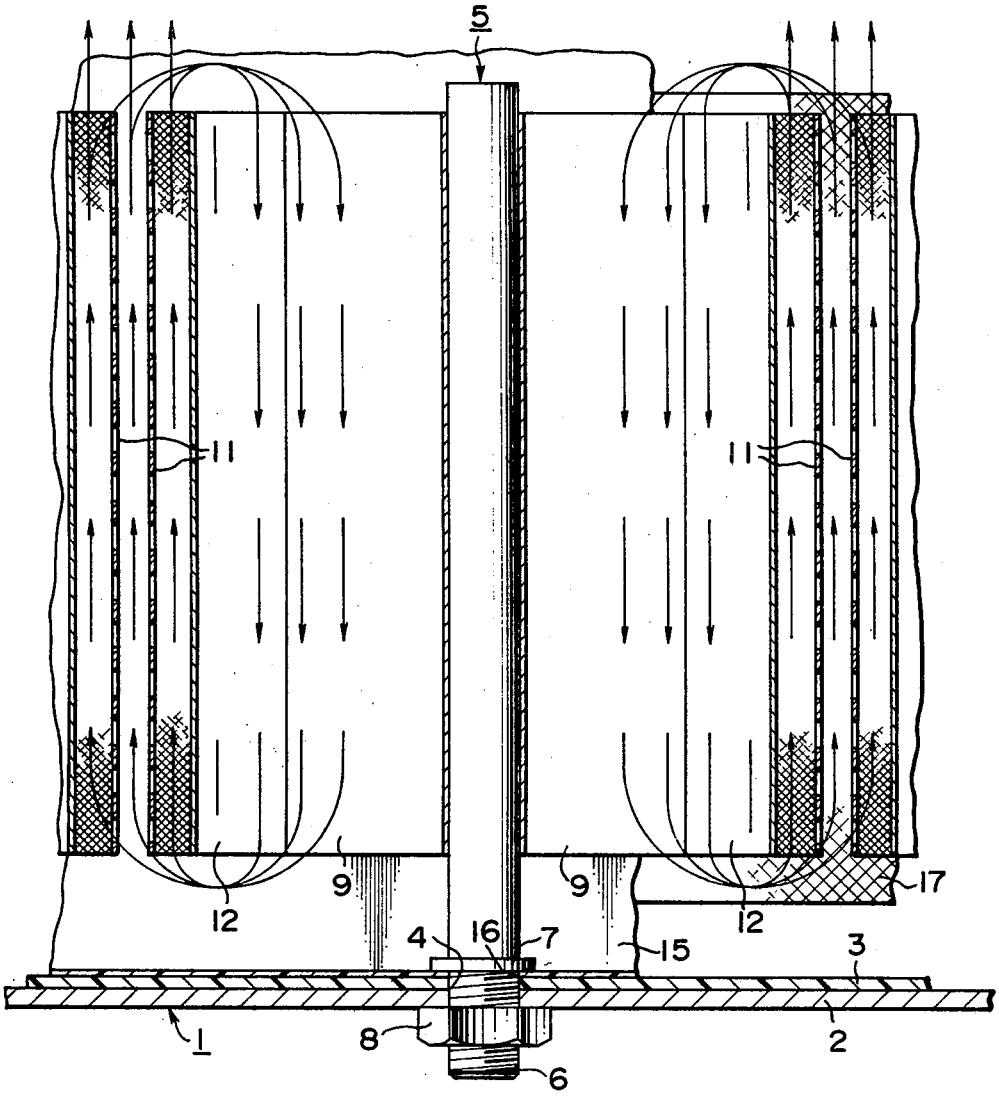
FIG. 5 is a longitudinal sectional view taken on line V—V in FIG. 4.

Referring now to FIGS. 4 and 5, in particular, an electrolytic cell bottom plate 1 comprises an electricity-supply plate 2 and anticorrosion sheet 3 provided on and overlying the plate 2. Threaded apertures 4 extend through the plate 2 and the sheet 3 at selected positions. An electrically conductive bar 5 is provided with a threaded portion 6 at its lower end. The bar 5 includes a flange 7 at the upper end of the threaded portion 6. The electrically conductive bar 5 is mounted to the electrolytic cell bottom plate 1 by threadably connecting the threaded portion 6 to the threaded aperture 4. A nut 8 is connected to a lower portion of the threaded portion 6 beneath the plate 2 and abutted against the lower face of the plate 2. A pair of elongated anode supporting bodies 9, formed of a bended elastic electrically conductive plate, are fixed to opposite sides of the electrically conductive bar 5. The bar 5 is centered within the structure. The ends of the anode supporting bodies 9, opposite the centered bar 5, are open to each side, as shown in FIG. 4, in the form of flange portions 10 having inner engaging surfaces.

A pair of opposed porous anode bodies 11, having a channel-shaped cross section, are arranged with both ends or less bent inwardly. The anode bodies 11 are fixed to the outer surfaces of respective ones of the pair of the anode supporting bodies 9.

A reinforced body 12 is formed by bending a rectangular plate, having a longitudinal length as long as that of each anode supporting body 9, to form open-ended outer receiving connecting portion surfaces 13 which turn inwardly. The reinforcing body 12 is inserted after the anode is expanded, and is designed to press directly against the anode body 11 to urge it outwardly of the center of the structure by detachably connecting the surfaces 13 inwardly of the inner engaging surfaces of the flange portions 10 of the anode supporting body 9, and by contacting bending portions 14 of the reinforcing body 12 to each inner surface of the opposed anode bodies 11 to brace the anode bodies 11.

The periphery of an aperture 16 of the bottom of a bag-shaped cation exchange membrane 15, which accomodates one or more anode comprising a pair of the opposed anode bodies 11, a pair of the anode supporting bodies 9, a pair of the reinforcing bodies 12 and the electrically conductive bar 5, is secured between the flange 7 of the electrically conductive bar 5 and the bottom plate 1 so that the bag-shaped cation exchange membrane 15 is provided in an electrolytic cell. A plurality of porous and hollow tubular cathodes 17 are disposed so that they extend from one inner side wall of the electrolytic cell to the opposite inner side wall thereof.

The anode for electrolysis of the present invention is structured so that a reinforcing body 12 is provided between the opposed anode bodies 11, as well as outside the anode supporting body 9, to increase the strength of each end of the anode bodies 11 so that each anode body 11 is not deformed by external force, and is not damaged.

When electrolyte, such as alkali metal halide solution, is supplied to a space 18 defined by the inner surface of the reinforcing body 12 and the inner surface of the anode supporting body 9, indicated by dashed lines in FIG. 4, the electrolyte flows down through the space as shown by downward arrows in FIG. 5 to a point near the electriyltic cell bottom plate 1. Then, the electrolyte runs into a space 19 defined by the outer surface of the reinforcing body 12 and the outer surface of the anode supporting body 9, indicated by dash-and dotted lines, to be electrolyzed so that generated halogen gas and electrolyte which has not been electrolyzed come up to the upper part of the electrolytic cell, where the generated gas can be removed from the electrolytic cell and the electrolyte which has not been electrolyzed can be recirculated. Accordingly, the circulation of the electrolyte and the discharge of the generated gas can be performed smoothly and the efficiency of the operation increases.

The reinforcing body of this invention is not limited to the structure which is made by bending the rectangular plate, and detachably connected portions as is described in the above embodiment. Reinforcing bodies of various structures, for example, a structure composed of a rectangular plate that is not bent, can be provided between the opposed anode bodies without a detachable connection of the plate with the anode supporting body, so as to reinforce the anode bodies and form the circulation path, can be used.

Anodes which can be used in this invention are not only the expandable anodes but also various anodes whose structures are made by facing two opposed anode bodies to each other.

What is claimed is:

1. An anode for electrolysis which comprises:

an electrolytic bottom plate;

an electrically conductive bar erected on the electrolytic bottom plate, anode supporting bodies connected to opposite sides of said conductive bar, each of said anode supporting bodies having two wing-like members projecting away from the conductive bar and ends which bend towards each other;

opposed anode bodies connected to the electrically conductive bar through contact with the wing-like members of the anode supporting bodies; and reinforcing bodies having closed outer portions and wing-like inner portions disposed between the anode bodies, the outer portions of each of which contacts and supports the anode bodies and the inner portions of each of which contacts the ends of the anode supporting bodies and thereby further supports the anode bodies, each of the reinforcing bodies and anode supporting bodies defining a closed channel through which electrolyte may move separately from gas generated during electrolysis.

* * * * *